United States Patent [19]

Satoh et al.

[11] Patent Number: 4,615,749

[45] Date of Patent: Oct. 7, 1986

[54] COLD ROLLED DUAL-PHASE STRUCTURE STEEL SHEET HAVING AN EXCELLENT DEEP DRAWABILITY AND A METHOD OF MANUFACTURING THE SAME

[75] Inventors: Susumu Satoh; Hideo Suzuki; Takashi Obara; Minoru Nishida; Osamu Hashimoto, all of Chiba, Japan

[73] Assignee: Kawasaki Steel Corporation, Kobe, Japan

[21] Appl. No.: 790,641

[22] Filed: Oct. 23, 1985

Related U.S. Application Data

[63] Continuation of Ser. No. 591,406, Mar. 20, 1984, abandoned.

[30] Foreign Application Priority Data

Feb. 18, 1984 [JP] Japan ..... 59-27995

[51] Int. Cl.[4] ..... C21D 9/46; C21D 7/02; C21D 7/14

[52] U.S. Cl. ..... 148/330; 148/12 C; 148/12 D; 148/12 F; 148/328

[58] Field of Search ..... 148/12 C, 12 D, 12 F, 148/12.4, 36

[56] References Cited

U.S. PATENT DOCUMENTS

| | | | |
|---|---|---|---|
| 3,988,173 | 10/1976 | Kawano | 148/12 C |
| 4,050,959 | 9/1977 | Nakaoka et al. | 148/12.3 |
| 4,062,700 | 12/1977 | Hayami et al. | 148/12.3 |
| 4,339,284 | 7/1982 | Hashimoto et al. | 148/12 F |
| 4,410,372 | 10/1983 | Takahashi et al. | 148/12.4 |
| 4,426,235 | 1/1984 | Sudo et al. | 148/12 C |

FOREIGN PATENT DOCUMENTS

| | | | |
|---|---|---|---|
| 0064552 | 5/1982 | European Pat. Off. . | |
| 0085720 | 2/1983 | European Pat. Off. . | |
| 0101740 | 9/1983 | European Pat. Off. . | |
| 110659 | 7/1983 | Japan | 148/12 C |
| 210125 | 12/1983 | Japan | 148/12 F |
| 8300507 | 2/1983 | World Int. Prop. O. | 148/12 C |

*Primary Examiner*—Wayland Stallard

*Attorney, Agent, or Firm*—Balogh, Osann, Kramer, Dvorak, Genova & Traub

[57] ABSTRACT

A cold rolled dual-phase structure steel sheet having an excellent deep drawability is disclosed, which consists of ferrite phase and low temperature transformation product phase and comprises 0.001–0.008 wt % of C, not more than 1.0 wt % of Si, 0.05–1.8 wt % of Mn, not more than 0.15 wt % of P, 0.01–0.10 wt % of Al, 0.002–0.050 wt % of Nb and 0.0005–0.0050 wt % of B provided that the value of Nb (%)+10B (%) is in a range of 0.010–0.080%, and, if necessary, 0.05–1.00 wt % of Cr and the balance being substantially Fe with inevitable impurities. This steel sheet is manufactured by hot and cold rolling a steel slab with the above chemical composition and continuously annealing the resulting steel sheet in such a manner than the steel sheet is heated and soaked at a temperature from $\alpha \rightarrow \gamma$ transformation point to 1,000° C. and then cooled at an average cooling rate of not less than 0.5° C./sec but less than 20° C./sec in a temperature range of from the soaking temperature to 750° C., and subsequently at an average cooling rate of not less than 20° C./sec in a temperature range of from 750° C. to not more than 300° C.

2 Claims, 3 Drawing Figures

COLD ROLLED DUAL-PHASE STRUCTURE STEEL SHEET HAVING AN EXCELLENT DEEP DRAWABILITY AND A METHOD OF MANUFACTURING THE SAME

This application is a continuation of application Ser. No. 591,406, filed Mar. 20, 1984 now abandoned.

BACKGROUND OF THE INVENTION

1. Field of the Invention

This invention relates to a cold rolled steel sheet suitable for use in, for example, automobile panels and the like requiring an excellent press formability. More particularly, the invention relates to an improvement in the properties of the above steel sheet through combined addition of Nb and B.

2. Description of the Prior Art

The cold rolled steel sheets for use in the above applications are required to have the following material characteristics:

(1) Deep Drawability:

The deep drawability is evaluated by a Lankford value ($\bar{r}$-value). The $\bar{r}$-value of not less than 2.0 is required in case of deeper drawing.

(2) High ductility:

A low yield strength (YS) and a high elongation (El) are required in order to achieve this characteristic.

(3) Non-aging property at room temperature:

This means that the material is not deteriorated by the age hardening even when it is stored at room temperature for a long period of time.

(4) Resistance to denting:

This means that the steel sheet after the press forming does not dent under a light load and is required to have a high yield strength of the steel sheet after the press forming.

Since the value YS is required to be low in the press forming, it is generally difficult to simultaneously realize both the press formability and the resistance to denting. However, it is possible to satisfy such conflicting properties in case of steel sheets having a property that it is hardened by the heating treatment (for instance, baked-on finish) subsequent to the press forming (hereinafter referred to as BH property).

The conventionally known cold rolled steel sheets for press forming are classified as follows:

(1) Steel sheets obtained by box annealing of low carbon aluminum-killed steel:

This steel sheet is excellent in the deep drawability, ductility, and non-aging property at room temperature, but has almost no baking hardenability and also the resulting press formed parts are poor in the resistance to denting. Further, since the low carbon aluminum-killed steel is used as a raw material, it is difficult to secure the above-enumerated properties thereof by the continuous annealing method which is considered to be advantageous from the standpoints of the productivity and the homogeneity of the product.

(2) Steel sheets obtained by adding Nb or Ti to an extremely low carbon steel:

This steel sheet exhibits excellent deep drawability and ductility even by the continuous annealing as in the case with the box annealing, and has the non-aging property at room temperature. Particularly, it has an extremely deep drawability because the $\bar{r}$-value is not less than 1.8. However, it is not easy to provide the BH property likewise the case (1), so that the press formed part is poor in the resistance to denting.

(3) Dual-phase structure steel sheets in which ferrite and martensite phase are made coexistent by adding alloying elements such as Si, Mn, Cr, etc. to low carbon aluminum-killed steel and controlling the cooling rate after the continuous annealing:

This steel sheet has the merit that because it has a lower yield strength as compared with the conventional steel sheet, it is excellent in the bulging property and is easy to gain a high strength. Further, it has a non-aging property at room temperature and a high BH property. However, it is poor in the drawability because the $\bar{r}$-value is as low as about 1.0.

Although the methods of manufacturing cold rolled steel sheets having a dual-phase structure have hitherto been disclosed in U.S. Pat. Nos. 4,050,959, and 4,062,700, Japanese Patent Application Publication No. 53-39,368, Japanese Patent laid open Nos. 50-75,113 and 51-39,524 and so on, all of them do not relate to a method of manufacturing steel sheets with a high $\bar{r}$-value, and are far behind the goal aiming at the invention.

SUMMARY OF THE INVENTION

It is, therefore, an object of the invention to provide a cold rolled steel sheet with a dual-phase structure possessing all of (1) high $\bar{r}$-value, (2) high ductility, (3) non-aging property at room temperature, and (4) high BH property.

According to a first aspect of the invention, there is the provision of a cold rolled dual-phase structure steel sheet having an excellent deep drawability and consisting of ferrite phase and low temperature transformation product phase, which comprises 0.001–0.008% by weight of C, not more than 1.0% by weight of Si, 0.05–1.8% by weight of Mn, not more than 0.15% by weight of P, 0.01–0.10% by weight of Al, 0.002–0.050% by weight of Nb and 0.0005–0.0050% by weight of B provided that the value of Nb(%)=10B(%) is in a range of 0.010–0.080%, and the balance being substantially Fe with inevitable impurities.

According to a second aspect of the invention, there is the provision of a method of manufacturing a cold rolled dual-phase structure steel sheet, comprising the steps of:

hot and cold rolling a steel slab with a composition containing 0.001–0.008% by weight of C, not more than 1.0% by weight of Si, 0.05–1.8% by weight of Mn, not more than 0.15% by weight of P, 0.01–0.10% by weight of Al, and 0.002–0.050% by weight of Nb and 0.0005–0.0050% by weight of B provided that the value of Nb(%)+10B(%) is in a range of 0.010–0.080% by weight; and continuously annealing the resulting steel sheet in such a manner that the steel sheet is heated and soaked at a temperature from $\alpha \rightarrow \gamma$ transformation point to 1,000° C. and then cooled at an average cooling rate of not less than 0.5° C./sec but less than 20° C./sec in a temperature range of from the soaking temperature to 750° C., and subsequently at an average cooling rate of not less than 20° C./sec in a temperature range of from 750° C. to not more than 300° C.

According to a third aspect of the invention, there is the provision of a cold rolled dual-phase structure steel sheet having an excellent deep drawability and consisting of ferrite phase and low temperature transformation product phase, which comprises 0.001–0.008% by weight of C, not more than 1.0% by weight of Si, 0.05–1.8% by weight of Mn, not more than 0.15% by weight of P, 0.01–0.10% by weight of Al, 0.05–1.00% by weight of Cr, 0.002–0.050% by weight of Nb and 0.0005–0.0050% by weight of B provided that the value of Nb(%)+10B(%) is in a range of 0.010–0.080%, and the balance being substantially Fe with inevitable impurities.

According to a fourth aspect of the invention, there is the provision of a method of manufacturing a cold rolled dual-phase structure steel sheet, comprising the steps of:

hot and cold rolling a steel slab with a composition containing 0.001–0.008% by weight of C, not more than 1.0% by weight of Si, 0.05–1.8% by weight of Mn, not more than 0.15% by weight of P, 0.01–0.10% by weight of Al, 0.05–1.00% by weight of Cr, and 0.002–0.050% by weight of Nb and 0.0005–0.0050% by weight of B provided that the value Nb(%)+10B(%) is in a range of 0.010–0.080%; and continuously annealing the resulting steel sheet in such a manner that the steel sheet is heated and soaked at a temperature of from $\alpha \rightarrow \gamma$ transformation point to 1,000° C. and then cooled at an average cooling rate of not less than 0.5° C./sec but less than 20° C./sec in a temperature range of from the soaking temperature to 750° C., and subsequently at an average cooling rate of not less than 20° C./sec in a temperature range of from 750° C. to not more than 300° C.

BRIEF DESCRIPTION OF THE DRAWINGS

The invention will be described in detail with reference to the accompanying drawing, wherein.

DETAILED DESCRIPTION OF THE INVENTION

First, the invention will be described from the studies based upon which the invention has been accomplished.

Figure 1:
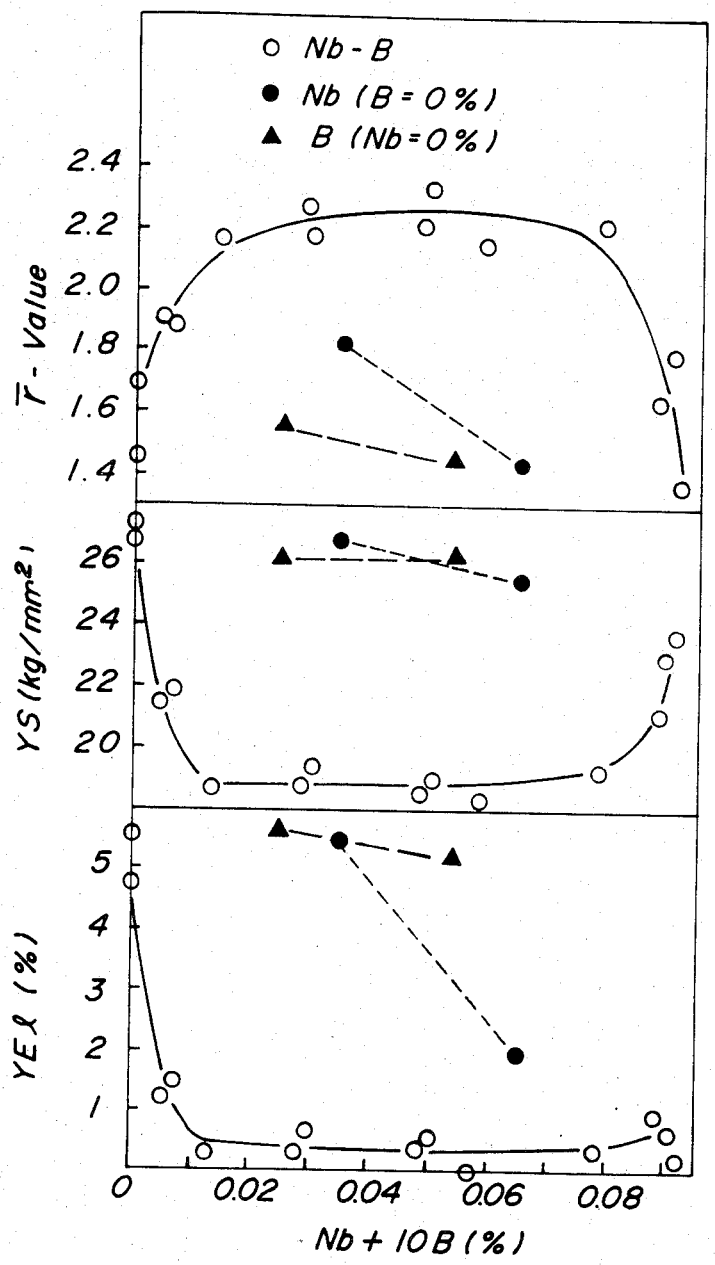
FIG. 1 is a graph showing the influence of Nb+10B as a parameter upon YEl, YS and $\bar{r}$-value.

FIG. 1 shows the yield point elongation (YEl), yield strength (YS) and Lankford value ($\bar{r}$-value) of a cold rolled steel sheet obtained by hot rolling-cold rolling-continuous annealing of a steel slab with a composition containing C≅0.004%, Mn≅0.3%, N≅0.004%, Al≅0.05% and variable amounts of Nb and B.

The continuous annealing was carried out in such a heat cycle that the resulting steel sheet was heated to 910° C., soaked at the same temperature for 20 seconds, and was cooled at an average cooling rate of 3.0° C./sec at a temperature range of from the soaking temperature to 750° C. and at an average cooling rate of 27° C./sec at a temperature range of not more than 750° C. The measured values of the above properties were obtained with respect to a JIS No. 5 test piece of the aforementioned steel sheet without skin pass rolling.

As understood from FIG. 1, the non-aging property at room temperature is obtained only in the steel sheet containing both Nb and B and having YEl of not more than 1%.

Further, it has been confirmed that the structure of the steel sheet has a dual-phase structure consisting of a ferrite phase and a low temperature transformation product phase having a high dislocation density (which is different from martensite phase of the conventional dual-phase structure steel sheet).

As shown in FIG. 1, the combined addition amount of Nb and B can be well related by a parameter of Nb(%)+10B(%) to the properties of the steel sheet. When the value of Nb(%)+10B(%) is less than 0.010%, the value of YEl is too high and no dual-phase structure is obtained, and the $\bar{r}$-value is low. On the other hand, when the value of Nb(%)+10B(%) exceeds 0.080%, the value of YS largely increases and the $\bar{r}$-value drops.

As apparent from FIG. 1, a high $\bar{r}$-value, a low YS, and non-aging property at room temperature (a low YEl) are first satisfied by setting the parameter value of Nb(%)+10B(%) in a range of 0.010–0.080%. Further, it was found that the steel sheet containing both Nb and B after the continuous annealing develops a property of largely increasing the yield strength (BH property) by applying a preliminary strain corresponding to a pressing force and subjecting to a heat treatment corresponding to a baked-on finish.

Figure 2:
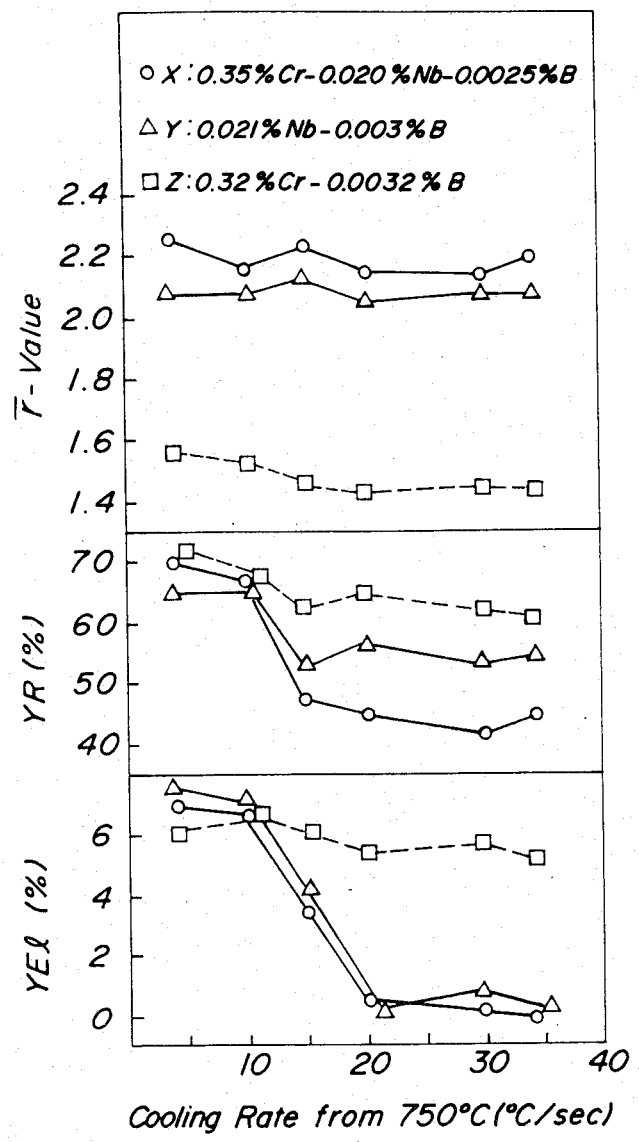
FIG. 2 is a graph showing the influence of the cooling rate from 750° C. of the continuous annealing heat cycle upon YEl, YR and $\bar{r}$-value.

With respect to three kinds of small size steel ingots obtained by combining adding Cr, Nb and/or B to an extremely low carbon aluminum-killed steel containing C≅0.005%, Mn≅0.3% and Al≅0.05% as base ingredients (Steel ingot X: Cr-Nb-B, Steel ingot Y: Nb-B, Steel ingot Z: Cr-B), FIG. 2 shows the relation of the average cooling rate in a temperature range of from 750° C. to room temperature at the time of annealing to the yield point elongation (YEl), the ratio of yield strength to tensile strength (YR) and the $\bar{r}$-value when the steel ingot is subjected to hot rolling-cold rolling-recrystallization annealing in laboratory. In this case, the soaking temperature was 900° C., and the cooling rate in a temperature range of from the soaking temperature to 750° C. was 5° C./sec. The values of the above properties were measured with respect to a JIS No. 5 test piece of the steel sheet without skin pass rolling.

In the Cr-B containing steel, the non-aging property at room temperature is not obtained because of the high YEl irrespective of the cooling rate, and the ductility is poor because the $\bar{r}$-value is low and YR is high.

On the other hand, the Nb-B containing steel can be imparted with the non-aging property at room temperature by controlling the cooling rate in the temperature range of from 750° C. to room temperature at not less than 20° C./sec, but YR is about 55% at this cooling rate and the ductility is slightly poor. Particularly, the Cr-Nb-B containing steel satisfies all of high $\bar{r}$-value, high ductility, and non-aging property at room temperature. It has also been found that the latter steel sheet has a so-called high BH property of increasing the yield strength by applying a light preliminary strain to the sheet and subjecting to a heat treatment at 170° C., and further confirmed that the structure of this steel sheet has the dual-phase structure consisting of a ferrite phase having a low dislocation density and a low temperature transformation product phase having a high dislocation density (which is different from martensite phase of the conventional dual-phase structure steel sheet).

The reasons why the composition of the steel sheet according to the invention is limited to the above ranges is as follows:

C:

If C content exceeds 0.008%, the $\bar{r}$-value conspicuously drops. If it is less than 0.001%, a high BH property cannot be obtained. Thus, the C content of carbon is restricted to a range of 0.001–0.008%, preferably 0.002–0.004%.

Si, P:

Si, and P are elements effective for obtaining the necessary strength level. If P is more than 0.15% and Si is more than 1%, the $\bar{r}$-value largely drops. Therefore, P is restricted to not more than 0.15% and Si is restricted to not more than 1.0%.

Mn:

Mn is necessary to be not less than 0.05% for preventing red shortness. If it exceeds 1.8%, the $\bar{r}$-value largely drops. Therefore, Mn is restricted to a range of 0.05%–1.8%, preferably 0.1–0.9%.

Al:

Al is effective for reducing the oxygen content of the steel and precipitation-fixing N in the form of AlN. For this purpose, Al content should be not less than 0.01%. If Al content exceeds 0.10%,the non-metallic inclusion rapidly increases and the ductility is deteriorated. Thus, Al is restricted to a range of 0.01–0.10%.

Nb, B:

These two alloying elements are particularly important in the invention, and the simultaneous addition of both the elements is indispensable therefor. If Nb is less than 0.002%, B is less than 0.0005%, and the value of Nb(%)+10B(%) is less than 0.010%, no dual-phase structure steel sheet can be obtained. While, if Nb is more than 0.050%, B is more than 0.0050%, and the value of Nb(%)+10B(%) is more than 0.080%, not only their addition effects are saturated, but also the ductility and $\bar{r}$-value are largely deteriorated. Therefore, according to the invention, it is essential that Nb is in a range of 0.002–0.050%, B is in a range of 0.0005–0.0050%, and the value of Nb(%)+10B(%) is in a range of 0.010–0.080%. Moreover, the mechanism on the effect by the simultaneous addition of Nb and B is not yet clear. Although B is known to improve the hardenability of steel products, as shown in FIG. 1, low temperature tranformation product phase is not formed by adding only B to the extremely low carbon aluminum-killed steel. Further, B is generally known to be an element of deteriorating the deep drawability ($\bar{r}$-value) of the cold rolled steel sheet, but according to the invention, an extremely high $\bar{r}$-value is attained in the steel sheet despite that it contains B.

That is, the effect by the simultaneous addition of Nb and B according to the invention has not been made public and is utterly novel.

According to the third aspect of the invention, the simultaneous addition of Cr, Nb and B is particularly important and indispensable.

Cr is particularly effective for obtaining a high $\bar{r}$-value and a low YR, i.e. a high ductility. If Cr content is less than 0.05%, the addition effect is not obtained, while if it exceeds 1.00%, not only the addition effect is saturated, but also the effect on the properties, particularly ductility is adversely affected. Therefore, the Cr content is limited to a range of 0.05–1.00%.

In the steel making, the extremely low carbon steel is most preferably melted by the combination of a bottom-blown converter and an RH degassing device.

The steel slab may be manufactured by either of blooming or continuous casting.

The hot rolling may be made by the conventional reheating system or direct hot-rolling method. Alternatively, a thin steel sheet of not more than 100 mm in thickness may be directly obtained from molten steel and subjected to hot rolling.

The optimum finishing temperature in the hot rolling is 950°–700° C.

Although the cooling means, the coiling temperature and so on of the hot rolled steel sheet are not so important according to the invention, the coiling temperature of not more than 600° C is preferable from the standpoint of pickling.

The draft in the cold rolling is preferably not less than 50% in order to obtain a high $\bar{r}$-value.

The heating rate in the continuous annealing is not so important, but it is preferably not less than 10° C./sec from the standpoint of the productivity. The soaking temperature is preferably in a range of from $\alpha \rightarrow \gamma$ transformation temperature to 1,000° C. The optimum range is 850°–950° C.

The cooling step after the soaking is important for obtaining the intended properties.

That is, it is necessary that the soaked sheet is subjected to a slow cooling from the soaking temperature to 750° C. at a cooling rate of 0.5°–20° C./sec and then cooled from 750° C. to not more than 300° C. at a cooling rate of not less than 20° C./sec. This will be described based on the experimental data below.

Figure 3:
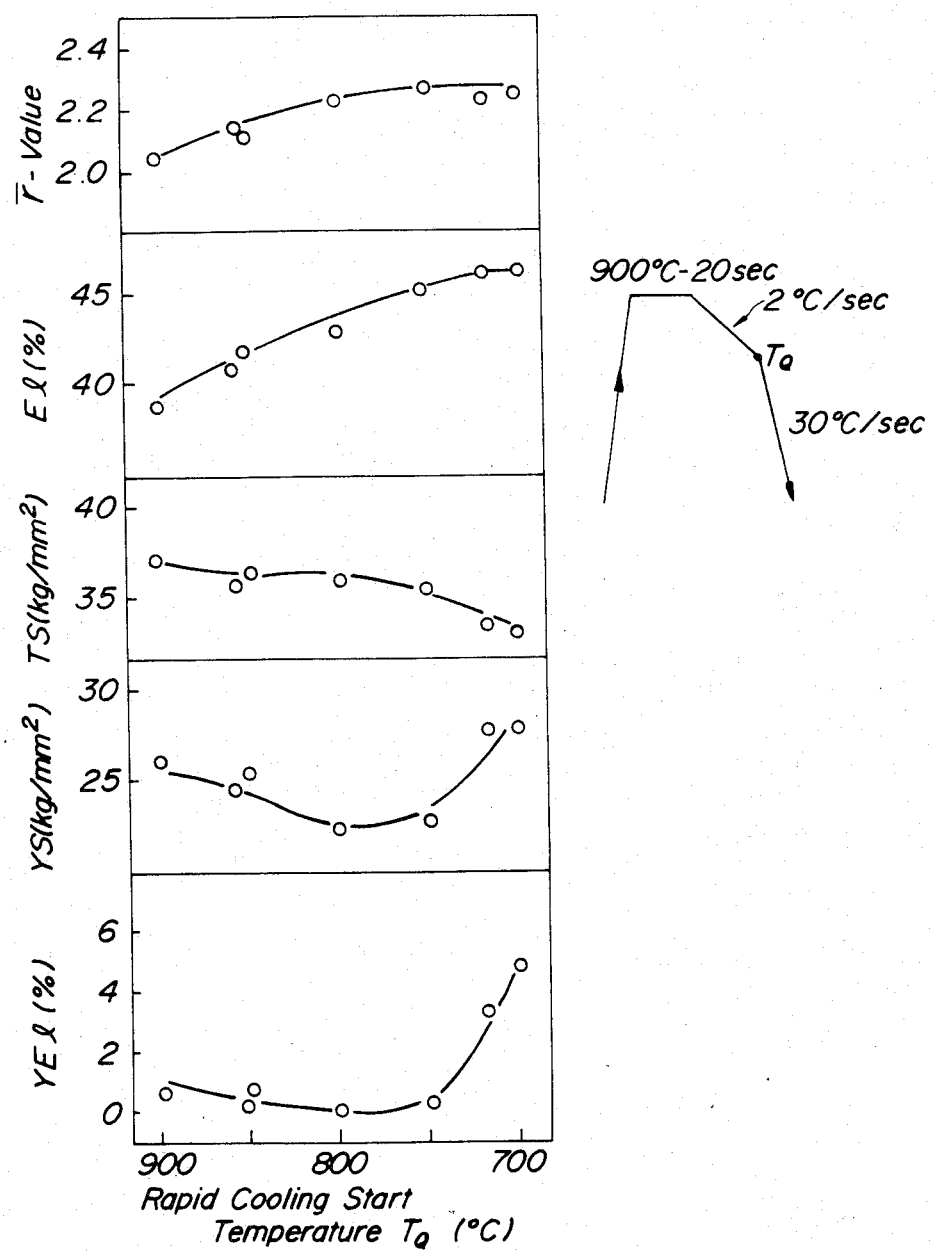
FIG. 3 is a graph showing the influence of the rapid cooling start temperature upon YEl, YS, TS, El and $\bar{r}$-value.

FIG. 3 shows the relation of the rapid cooling start temperature at the time of the annealing to the yield point elongation (YEl), yield strength (YS), tensile strength (TS), total elongation (El) and $\bar{r}$-value when a steel sheet containing 0.004% of C, 0.50% of Mn, 0.02% of P, 0.056% of Al, 0.015% of Nb and 0.0026% of B was subjected to hot rolling-cold rolling-recrystallization annealing. In this case, the soaking temperature was 900° C., the cooling rate up to the rapid cooling start temperature was 2° C./sec and the rapid cooling rate was 30° C./sec. The values of the above properties were measured with respect to a JIS No. 5 test piece of the steel sheet without skin pass rolling.

When the rapid cooling starts immediately from the soaking temperature, YEl becomes not more than 1% and the non-aging property at room temperature is attained but the yield strength becomes rather higher with respect to the tensile strength level and the elongation is low. On the contrary, when slow cooling is performed from the soaking temperature to 750° C., the reduction of YS and the increase of El are conspicuous. However, if slow cooling is performed down to 750° C., YEl abruptly increases.

It is understood from the above that the cooling step after the soaking in the continuous annealing is important for obtaining the desirable cold rolled steel sheet.

After the annealing, the steel sheet may be subjected to skin pass rolling for the purpose of correcting the profile thereof. In this case, the draft of the skin pass rolling is sufficient to be not more than 2% because the yield point elongation (YEl) is low.

On the other hand, the steel sheet according to the invention may be subjected to a surface treatment such as galvanization or the like without troubles. Particularly, the steel sheet according to the invention is suitable for the production of the surface treated steel sheet by hot dipping in an inline annealing system (including an alloying treatment).

Eight steel slabs were obtained by continuously casting steels A-H each having a chemical composition as shown in the following Table 1 after the treatment through the bottom-blown converter and RH-degassing device.

TABLE 1

| Steel | C | Si | Mn | P | S | Al | N | Nb | B | Nb + 10B |
|---|---|---|---|---|---|---|---|---|---|---|
| A* | 0.005 | 0.02 | 0.30 | 0.014 | 0.01 | 0.05 | 0.0025 | 0.002 | 0.0002 | 0.004 |
| B | 0.003 | 0.01 | 0.15 | 0.040 | 0.01 | 0.03 | 0.0036 | 0.011 | 0.0015 | 0.026 |
| C | 0.004 | 0.02 | 0.60 | 0.015 | 0.01 | 0.07 | 0.0018 | 0.027 | 0.0030 | 0.057 |
| D* | 0.007 | 0.02 | 0.30 | 0.020 | 0.01 | 0.06 | 0.0025 | 0.045 | 0.0062 | 0.107 |
| E* | 0.010 | 0.01 | 0.32 | 0.016 | 0.01 | 0.04 | 0.0042 | 0.022 | 0.0026 | 0.048 |
| F | 0.004 | 0.01 | 0.80 | 0.016 | 0.01 | 0.03 | 0.0016 | 0.018 | 0.0022 | 0.040 |
| G* | 0.005 | 0.01 | 1.92 | 0.015 | 0.01 | 0.04 | 0.0033 | 0.020 | 0.0030 | 0.050 |
| H | 0.004 | 0.02 | 0.51 | 0.81 | 0.01 | 0.04 | 0.0031 | 0.008 | 0.0025 | 0.033 |

*Comparative Example

Each steel slab was soaked at 1,200° C., hot rolled at a finishing temperature of 860°-900° C. and at a coiling temperature of 500°-600° C. to obtain a steel sheet of 3.2 mm in thickness. After the pickling, it was cold rolled to be 0.8 mm in thickness and then subjected to a continuous annealing under such conditions that the soaking temperature is 910° C., the average cooling rate in a temperature range of from 910° C. to 750° C. is 3.2° C./sec, and the average cooling rate in a temperature range of from 750° C. to 250° C. is 40° C./sec, whereby there was obtained a cold rolled steel sheet having properties as shown in the following Table 2.

TABLE 2

| Steel | YEl (%) | YS (kg/mm²) | TS (kg/mm²) | YR (%) | El (%) | $\bar{r}$ | ΔYS (kg/mm²) | BH (kg/mm²) |
|---|---|---|---|---|---|---|---|---|
| A* | 5.6 | 25 | 32 | 78.1 | 44 | 1.73 | 4.2 | 6.3 |
| B | 0.3 | 17 | 31 | 54.8 | 50 | 2.34 | 0.4 | 4.8 |
| C | 0.1 | 20 | 36 | 55.6 | 45 | 2.12 | 0.6 | 5.2 |
| D* | 0.5 | 25 | 34 | 73.5 | 39 | 1.40 | 0.7 | 4.5 |
| E* | 4.1 | 27 | 34 | 79.4 | 38 | 1.53 | 3.5 | 6.2 |
| F | 0.4 | 23 | 38 | 60.5 | 41 | 2.02 | 0.6 | 5.5 |
| G* | 0.2 | 28 | 44 | 63.6 | 31 | 1.26 | 0.4 | 5.1 |
| H | 0 | 24 | 40 | 60.0 | 38 | 2.14 | 0.3 | 4.5 |

*Comparative Example

The tensile test was made with respect to a JIS No. 5 test piece of the steel sheet. In Table 2, ΔYS is represented by the increased amount (kg/mm²) of YS after the aging treatment at 35° C. for 100 days, and BH is represented by the difference between the deformation stress produced in the application of preliminary strain under a 2% tension and deformation strain produced in the treatment corresponding to a bake-on finish at 170° C. for 20 minutes. In the invention steels (B, C, F and H), the $\bar{r}$-value is not less than 2.0, and a high ductility, non-aging property at room temperature, and a high BH property are obtained. Moreover, examples C, H, and F are production examples of high strength cold rolled steel sheets having TS of not less than 35 kg/mm².

On the other hand, the steel having the composition C of Table 1 was subjected to a continuous annealing under conditions shown in the following Table 3 to obtain a cold rolled steel sheet having properties as shown in the following Table 4.

TABLE 3

| Steel C | Average cooling rate from 910° C. to 750° C. (°C./sec) | Average cooling rate from 750° C. to 280° C. (°C./sec) |
|---|---|---|
| 1* | 0.3 | 41 |
| 2 | 1.1 | 34 |
| 3 | 2.5 | 33 |
| 4* | 2.0 | 14 |
| 5 | 15 | 65 |
| 6* | 25 | 40 |

*Comparative Example

TABLE 4

| Steel C | YEl (%) | YS (kg/mm²) | TS (kg/mm²) | El (%) | $\bar{r}$ | ΔYS (kg/mm²) | BH (kg/mm²) |
|---|---|---|---|---|---|---|---|
| 1* | 4.1 | 24 | 34 | 45 | 1.81 | 3.2 | 5.8 |
| 2 | 0.5 | 19 | 35 | 46 | 2.16 | 0.6 | 4.9 |
| 3 | 0.1 | 20 | 36 | 45 | 2.30 | 0.6 | 5.2 |
| 4* | 5.1 | 26 | 33 | 44 | 1.91 | 4.0 | 3.5 |
| 5 | 0 | 20 | 37 | 44 | 2.07 | 0.2 | 6.0 |
| 6* | 1.1 | 24 | 37 | 36 | 1.75 | 1.5 | 5.6 |

*Comparative Example

It is apparent from Table 4 that the steel sheet (2, 3 and 5) treated under the optimum conditions of the invention have the intended excellent properties.

Ten steel slabs were obtained by continuously casting steels I-R each having a chemical composition as shown in the following Table 5 after the treatment through the bottom-blown converter and RH-degassing device.

TABLE 5

| Steel | C | Si | Mn | P | S | Al | N | Cr | Nb | B | (wt %) Nb + 10B |
|---|---|---|---|---|---|---|---|---|---|---|---|
| I* | 0.005 | 0.01 | 0.50 | 0.01 | 0.01 | 0.045 | 0.0032 | 0.35 | 0.002 | 0.0002 | 0.004 |
| J | 0.003 | 0.02 | 0.80 | 0.01 | 0.01 | 0.036 | 0.0025 | 0.36 | 0.010 | 0.0008 | 0.018 |
| K | 0.004 | 0.01 | 0.15 | 0.10 | 0.01 | 0.025 | 0.0042 | 0.80 | 0.006 | 0.0030 | 0.036 |
| L | 0.004 | 0.02 | 0.53 | 0.01 | 0.01 | 0.0025 | 0.0026 | 0.40 | 0.015 | 0.0025 | 0.040 |
| M | 0.008 | 0.85 | 0.40 | 0.05 | 0.01 | 0.060 | 0.0025 | 0.10 | 0.015 | 0.0045 | 0.060 |
| N* | 0.003 | 0.02 | 0.52 | 0.05 | 0.01 | 0.018 | 0.0022 | 0.52 | 0.048 | 0.0043 | 0.091 |
| O* | 0.012 | 0.01 | 0.51 | 0.02 | 0.01 | 0.035 | 0.0026 | 0.40 | 0.020 | 0.0025 | 0.045 |
| P* | 0.005 | 0.02 | 2.15 | 0.01 | 0.01 | 0.042 | 0.0042 | 0.50 | 0.019 | 0.0030 | 0.049 |
| Q* | 0.004 | 0.01 | 0.56 | 0.01 | 0.01 | 0.028 | 0.0022 | 0.02 | 0.025 | 0.0020 | 0.045 |

TABLE 5-continued

| Steel | C | Si | Mn | P | S | Al | N | Cr | Nb | B | (wt %) Nb + 10B |
|---|---|---|---|---|---|---|---|---|---|---|---|
| R* | 0.004 | 0.0 | 0.15 | 0.02 | 0.01 | 0.033 | 0.0018 | 1.16 | 0.009 | 0.0025 | 0.034 |

*Comparative Example

Each steel slab was soaked at 1,200° C., hot rolled at a finishing temperature of 860°-900° C. and at a coiling temperature of 500°-600° C. to obtain a steel sheet of 3.2 mm in thickness. After the pickling, it was cold rolled to be 0.8 mm in thickness and then subjected to a continuous annealing under such conditions that the soaking temperature is 900° C., the average cooling rate in a temperature range of from 910° C. to 750° C. is 4.2° C./sec, and the average cooling rate in a temperature range of from 750° C. to 280° C. is 34° C./sec, whereby there was obtained a cold rolled steel sheet having properties as shown in the following Table 6.

TABLE 6

| Steel | YEl (%) | YS (kg/mm²) | TS (kg/mm²) | YR (%) | El (%) | $\bar{r}$ | ΔYS (kg/mm²) | BH (kg/mm²) |
|---|---|---|---|---|---|---|---|---|
| I* | 6.5 | 27 | 33 | 82 | 40 | 1.4 | 4.5 | 5.0 |
| J | 0.3 | 17.5 | 38 | 46 | 42 | 2.2 | 0.6 | 5.2 |
| K | 0.2 | 19 | 42 | 45 | 39 | 2.1 | 0.3 | 5.7 |
| L | 0 | 15 | 33 | 45 | 46 | 2.3 | 0.3 | 4.3 |
| M | 0.5 | 21 | 45 | 46 | 36 | 2.0 | 0.5 | 4.6 |
| N* | 0.1 | 25 | 37 | 68 | 32 | 1.5 | 0.4 | 3.5 |
| O* | 3.5 | 27 | 35 | 77 | 29 | 1.3 | 3.1 | 4.5 |
| P* | 0.6 | 31 | 46 | 67 | 25 | 1.2 | 0.5 | 5.2 |
| Q* | 0.4 | 21 | 37 | 57 | 37 | 1.5 | 0.8 | 4.5 |
| R* | 0.5 | 25 | 36 | 70 | 38 | 1.5 | 0.4 | 3.8 |

*Comparative Example

The tensile test was made with respect to a JIS No. 5 test piece of the steel sheet. In Table 6, ΔYS is represented by the increased amount (kg/mm²) of YS after the aging treatment at 35° C. for 100 days, and BH is represented by the difference between the deformation stress produced in the application of preliminary strain under a 2% tension and deformation strain produced in the treatment corresponding to a bake-on finish at 170° C. for 20 minutes. In the invention steels (J, K, L and M), a high $\bar{r}$-value, a high ductility, non-aging property at room temperature, and a high BH property are obtained.

On the other hand, the steel having the composition L of Table 5 was subjected to a continuous annealing under conditions shown in the following Table 7 to obtain a cold rolled steel sheet having properties as shown in the following Table 8.

TABLE 7

| Steel L | Average cooling rate from soaking temperature to 750° C. (°C./sec) | Average cooling rate from 750° C. to 280° C. (°C./sec) | Soaking temperature (°C.) |
|---|---|---|---|
| 1* | 1.2 | 40 | 770 |
| 2* | 0.3 | 32 | 880 |
| 3 | 0.9 | 41 | 830 |
| 4 | 3.2 | 25 | 960 |
| 5* | 23 | 31 | 910 |
| 6* | 2.5 | 15 | 920 |
| 7 | 2.7 | 75 | 890 |
| 8* | 1.8 | 38 | 1,040 |

*Comparative Example

TABLE 8

| Steel L | YEl (%) | YS (kg/mm²) | TS (kg/mm²) | YR (%) | El (%) | $\bar{r}$ | ΔYS (kg/mm²) | BH (kg/mm²) |
|---|---|---|---|---|---|---|---|---|
| 1* | 7.2 | 25 | 34 | 74 | 45 | 1.4 | 3.5 | 6.1 |
| 2* | 2.1 | 24 | 33 | 73 | 45 | 1.7 | 2.4 | 5.6 |
| 3 | 0.1 | 15.5 | 34 | 46 | 45 | 2.1 | 0.5 | 5.1 |
| 4 | 0.4 | 15 | 33 | 45 | 47 | 2.3 | 0.2 | 5.8 |
| 5* | 3.5 | 21 | 37 | 57 | 38 | 1.7 | 3.8 | 5.2 |
| 6* | 6.5 | 26 | 32 | 81 | 43 | 1.8 | 4.2 | 6.3 |
| 7 | 0.2 | 15.5 | 35 | 44 | 43 | 2.0 | 0.5 | 5.5 |
| 8* | 0.5 | 18 | 34 | 53 | 32 | 1.4 | 1.0 | 4.5 |

*Comparative Example

It is seen apparent from Table 8 that the steel sheets (L-3, L-4 and L-7) treated under the optimum conditions according to the third aspect of the invention have the intended excellent properties.

According to the first and third aspects of the invention, it is possible to realize a deep drawability, a high ductility, and non-aging property at room temperature together with a sufficiently high resistance to denting under a low YS before press forming, in case of the cold rolled steel sheets which are required to have an excellent press formability for use in automobile panels and so on, and also these steel sheets can advantageously be manufactured according to the second and fourth aspects of the invention.

What is claimed is:

1. A cold rolled dual-phase structure steel sheet having an excellent deep drawability or $\bar{r}$ value not less than 2.0, a brake hardenability (BH) not smaller than 4.3 Kg/mm², an aging index (AI) not less than 3.3 Kg/mm², and consisting of a ferrite phase and low temperature transformation product phase, which steel sheet consists of 0.001-0.008% by weight of C, not more than 1.0% by weight of Si, 0.05-1.8% by weight of Mn, not more than 0.15% by weight of P, 0.01-0.10% by weight of Al, 0.002-0.050% by weight of Nb, and 0.0005-0.0050% by weight of B, provided that the value of Nb(%)+10B(%) is in a range of 0.010-0.080%, and the balance being substantially Fe with inevitable impurities, and is produced by the steps of:

hot and cold rolling a steel slab with a composition containing 0.001-0.008% by weight of C, not more than 1.0% by weight of Si, 0.05-1,8% by weight of Mn, not more than 0.15% by weight of P, 0.01-0.10% by weight of Al, and 0.002-0.050% by weight of Nb and 0.0005-0.0050% by weight of B provided that the value of Nb(%)+10(%) is in a range of 0.010-0.080% by weight; and continuously annealing the resulting steel sheet in such a manner that the steel sheet is heated and soaked at a temperature from $\alpha \rightarrow \gamma$ transformation point to 1,000° C. and then cooled at an average cooling rate of not less than 0.5° C./sec but less than 20° C./sec in a temperature range of from the soaking temperature to 750° C., and subsequently at an average cooling rate of not less than 20° C./sec in a temperature range of from 750° C. to not more than 300° C.

2. A cold rolled dual-phase structure steel sheet having an excellent deep drawability or $\bar{r}$ value not less than 2.0, a bake hardenability (BH) not smaller than 4.3 $Kg/mm^2$, an aging index (AI) not less than 3.3 $Kg/mm^2$, and consisting of ferrite phase and low temperature transformation product phase, which steel sheet consists of 0.0001–0.008% by weight of C, not more than 1.0% by weight of Si, 0.05–1.8% by weight of Mn, not more than 0.15% by weight of P, 0.01–0.10% by weight of Al, 0.05–1.00% by weight of Cr, 0.002–0.050% by weight of Nb and 0.0005–0.0050% by weight of B provided that the value of Nb(%)+10B(%) is in a range of 0.010–0.080%, and the balance being substantially Fe with inevitable impurities.

* * * * *